US008800853B2

(12) United States Patent
Brand

(10) Patent No.: US 8,800,853 B2
(45) **Date of Patent: *Aug. 12, 2014**

(54) CARTON WITH DIVIDER

(71) Applicant: Graphic Packaging International, Inc., Atlanta, GA (US)

(72) Inventor: Kirsten L. Brand, Hackettstown, NJ (US)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/759,437

(22) Filed: Feb. 5, 2013

(65) Prior Publication Data

US 2013/0146650 A1 Jun. 13, 2013

Related U.S. Application Data

(63) Continuation of application No. 12/635,111, filed on Dec. 10, 2009, now Pat. No. 8,459,535, which is a continuation of application No. PCT/US2008/068006, filed on Jun. 24, 2008.

(60) Provisional application No. 60/947,088, filed on Jun. 29, 2007.

(51) Int. Cl.

| | |
|---|---|
| ***B65D 5/498*** | (2006.01) |
| ***B65D 5/54*** | (2006.01) |
| ***B31B 1/26*** | (2006.01) |
| ***B31B 11/00*** | (2006.01) |
| ***B31B 1/90*** | (2006.01) |

(52) U.S. Cl.

USPC ..... 229/120.38; 493/84; 493/90; 493/137; 493/162; 229/122; 229/235

(58) Field of Classification Search

USPC ..... 229/200, 120.011, 120.11, 120.13, 229/120.08, 120.14, 117.15, 117.16, 229/117.17, 120.27; 493/90; 206/521.15, 206/738, 739, 740, 745, 746, 747, 748, 750, 206/45.21, 45.22, 45.25, 45.27, 45.3

See application file for complete search history.

(56) References Cited

U.S. PATENT DOCUMENTS

| | | | |
|---|---|---|---|
| 1,896,646 | A | 2/1922 | Taylor |
| 1,896,326 | A | 2/1933 | Northway-Ley |

(Continued)

FOREIGN PATENT DOCUMENTS

| | | |
|---|---|---|
| CH | 263456 | 8/1949 |
| DE | 88 14 144 | 1/1989 |

(Continued)

OTHER PUBLICATIONS

International Search Report and Written Opinion for PCT/US2008/068006, mailed Jun. 14, 2010.

(Continued)

*Primary Examiner* — Gary Elkins
*Assistant Examiner* — Christopher Demeree
(74) *Attorney, Agent, or Firm* — Womble Carlyle Sandridge & Rice, LLP

(57) ABSTRACT

A carton for containing a plurality of articles. The carton comprises panels that extend at least partially around an interior of the carton. The panels comprise a top panel, a bottom panel, a first side panel, and a second side panel. At least one divider panel is in the interior of the carton. The divider panel is attached to at least one of the panels. A dispenser is for allowing access to the articles in the carton. The dispenser is for separating the carton into a first portion and a second portion. At least one of the first portion and the second portion is at least partially closed by the at least one divider panel.

23 Claims, 10 Drawing Sheets

(56) References Cited

U.S. PATENT DOCUMENTS

| | | | | | |
|---|---|---|---|---|---|
| 2,299,027 | A | * | 10/1942 | Novak | 229/122.1 |
| 2,875,952 | A | | 3/1959 | Wilson | |
| 3,056,665 | A | * | 10/1962 | Linda et al. | 431/35 |
| 3,101,880 | A | | 8/1963 | Peterson | |
| 3,158,312 | A | | 11/1964 | Simkins | |
| 3,166,232 | A | * | 1/1965 | Tichenor | 229/221 |
| 3,822,785 | A | | 7/1974 | Getz et al. | |
| 3,937,326 | A | | 2/1976 | Schick | |
| 4,105,154 | A | | 8/1978 | Meyers et al. | |
| 4,120,443 | A | | 10/1978 | Gardner et al. | |
| 4,421,229 | A | | 12/1983 | Pan et al. | |
| 4,577,799 | A | | 3/1986 | Oliff | |
| 4,919,269 | A | | 4/1990 | Wright et al. | |
| 5,234,102 | A | | 8/1993 | Schuster et al. | |
| 5,246,113 | A | | 9/1993 | Schuster | |
| 5,316,210 | A | | 5/1994 | Scullin | |
| 5,415,344 | A | | 5/1995 | Harrelson | |
| 5,427,242 | A | | 6/1995 | Oliff et al. | |
| 5,437,143 | A | | 8/1995 | Culpepper et al. | |
| 5,518,111 | A | | 5/1996 | Stout | |
| 5,620,094 | A | | 4/1997 | Naumann | |
| 5,669,500 | A | | 9/1997 | Sutherland | |
| 5,682,984 | A | | 11/1997 | Howell et al. | |
| 5,699,957 | A | | 12/1997 | Blin et al. | |
| 5,772,030 | A | | 6/1998 | Baxter | |
| 5,826,783 | A | | 10/1998 | Stout | |
| 5,826,870 | A | | 10/1998 | Vulgamore et al. | |
| 5,848,686 | A | | 12/1998 | Dean | |
| 5,868,252 | A | | 2/1999 | Oliff | |
| 5,938,109 | A | | 8/1999 | Sainz et al. | |
| 5,957,288 | A | | 9/1999 | Campbell | |
| 5,967,406 | A | | 10/1999 | Moorman | |
| 5,996,883 | A | | 12/1999 | Bates | |
| 6,012,630 | A | | 1/2000 | Block | |
| 6,112,977 | A | | 9/2000 | Sutherland et al. | |
| 6,176,419 | B1 | | 1/2001 | Holley, Jr. | |
| 6,244,502 | B1 | | 6/2001 | Hollar et al. | |
| 6,386,369 | B2 | | 5/2002 | Yuhas et al. | |
| 6,918,487 | B2 | | 7/2005 | Harrelson | |
| 6,991,107 | B2 | | 1/2006 | Harrelson | |
| 7,093,713 | B2 | | 8/2006 | Sutherland | |
| 7,168,558 | B2 | | 1/2007 | Harrelson | |
| 7,195,118 | B2 | | 3/2007 | Sutherland | |
| 7,475,778 | B2 | | 1/2009 | Sutherland | |
| 7,717,321 | B2 | | 5/2010 | Spivey, Sr. et al. | |
| 2004/0245327 | A1 | | 12/2004 | Oliff et al. | |

FOREIGN PATENT DOCUMENTS

| | | | |
|---|---|---|---|
| DE | 91 11 941 | | 2/1992 |
| EP | 0 595 602 | | 5/1994 |
| FR | 1427897 | | 4/1966 |
| FR | 1489087 | | 7/1967 |
| FR | 1497652 | | 10/1967 |
| FR | 2223985 | | 10/1974 |
| GB | 434145 | | 8/1935 |
| GB | 2 198 709 | | 6/1988 |
| GB | 2 323 352 | | 9/1998 |
| JP | 62-062617 | A | 10/1985 |
| JP | 62-130024 | | 8/1987 |
| JP | 1-73121 | | 5/1989 |
| JP | 7 125745 | | 5/1995 |
| JP | 9 142449 | | 6/1997 |
| JP | 11-130049 | | 5/1999 |
| JP | 2000-85754 | | 3/2000 |
| JP | 2002-526346 | A | 8/2002 |
| WO | WO 92/07772 | | 5/1992 |
| WO | WO 96/29261 | | 9/1996 |
| WO | WO 00/20288 | | 4/2000 |
| WO | WO 01/30659 | A1 | 5/2001 |
| WO | WO 02/030764 | | 4/2002 |
| WO | WO 2004/014755 | | 2/2004 |

OTHER PUBLICATIONS

Supplementary European Search Report for EP 08 78 0950, dated Dec. 5, 2011.

Office Action for U.S. Appl. No. 12/635,111, dated Dec. 21, 2011.

Amendment a and Response to Office Action for U.S. Appl. No. 12/635,111, dated Mar. 19, 2011.

Office Action for U.S. Appl. No. 12/635,111, dated Jun. 6, 2012.

Amendment B and Response to Office Action for U.S. Appl. No. 12/635,111, dated Sep. 6, 2012.

Office Action for U.S. Appl. No. 12/635,111, dated Dec. 6, 2012.

Amendment C and Response to Final Office Action for U.S. Appl. No. 12/635,111, dated Feb. 4, 2013.

Notice of Allowance and Fee(s) Due for U.S. Appl. No. 12/635,111, dated Feb. 22, 2013.

Part B—Fee(s) Transmittal for U.S. Appl. No. 12/635,111, dated May 7, 2013.

Issue Notification for U.S. Appl. No. 12/635,111, dated May 22, 2013.

* cited by examiner

CARTON WITH DIVIDER

CROSS-REFERENCE TO RELATED APPLICATIONS

This application is a continuation application of U.S. patent application Ser. No. 12/635,111, filed Dec. 10, 2009, which is a continuation application of prior PCT Application No. PCT/US2008/068006, filed Jun. 24, 2008, entitled "Carton With Divider," which PCT application claims the benefit of U.S. Provisional Application No. 60/947,088, filed on Jun. 29, 2007.

INCORPORATION BY REFERENCE

The entire disclosures of U.S. patent application Ser. No. 12/635,111, filed Dec. 10, 2009, PCT Application No. PCT/US2008/068006, filed Jun. 24, 2008, and U.S. Provisional Application No. 60/947,088, filed Jun. 29, 2007, are incorporated by reference as if set forth herein in their entireties, for all purposes.

BACKGROUND OF THE DISCLOSURE

The present disclosure generally relates to cartons for holding and dispensing beverage containers or other types of articles.

SUMMARY OF THE DISCLOSURE

In general, one aspect of the disclosure is directed a carton for containing a plurality of articles. The carton comprising panels that extend at least partially around an interior of the carton. The panels comprise a top panel, a bottom panel, a first side panel, and a second side panel. At least one divider panel is in the interior of the carton. The divider panel is attached to at least one of the panels. A dispenser is for allowing access to the articles in the carton. The dispenser separates the carton into a first portion and a second portion. At least one of the first portion and the second portion is at least partially closed by the at least one divider panel.

In another aspect, the disclosure is generally directed to blanks for forming a carton for containing at least one divider. The blanks comprise a first blank for being formed into the carton. The first blank comprises a plurality of panels comprising at least a top panel, a bottom panel, a first side panel, and a second side panel. The first blank comprises dispenser features for separating the carton formed from the first blank into a first portion and a second portion. The blanks comprise a second blank for forming the divider. The divider is for at least partially closing at least one of the first portion and the second portion of the carton. The second blank comprises at least one divider panel having an attachment flap foldably connected thereto. The attachment flap is positioned for attachment to one of the panels of the first blank.

In another aspect, the disclosure is generally directed to a method of forming a carton from a blank. The method comprises providing a carton blank and a divider blank. The carton blank comprises a plurality of panels comprising at least a top panel, a bottom panel, a first side panel, and a second side panel. The carton blank comprises dispenser features. The divider blank comprises at least one divider panel having at least one attachment flap foldably connected thereto. The method further comprising attaching the divider blank to the carton blank by securing the at least one attachment flap to one of the panels. A carton is formed from the carton blank by positioning the top panel, bottom panel, first side panel, and second side panel to form a generally open-ended sleeve. The divider is formed by positioning the divider blank to divide the carton into a first portion and a second portion.

In another aspect, the disclosure is generally directed to a blank for forming a divider of a carton. The blank comprising at least one divider panel and a first attachment flap foldably connected to the at least one divider panel. The first attachment flap being at least partially defined by at least one cut line in the at least one divider panel. A second attachment flap is foldably connected to the at least one divider panel. The second attachment flap is at least partially defined by at least one cut line in the at least one divider panel. The first and the second attachment flap are independently positionable relative to the divider panel to attach the divider to respective panels of the carton.

In another aspect, the disclosure is directed to a carton for containing a plurality of articles. The carton comprising panels that extend at least partially around an interior of the carton and at least one divider panel in the interior of the carton. The divider panel is attached to at least one of the panels.

Other aspects, features, and details of the present disclosure can be more completely understood by reference to the following detailed description of exemplary embodiments taken in conjunction with the drawings and from the appended claims.

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to various features for cartons that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., glass beverage bottles) as disposed within the carton embodiments. In this specification, the terms "lower," "bottom," "upper," and "top" indicate orientations determined in relation to fully erected and upright cartons.

Figure 1:
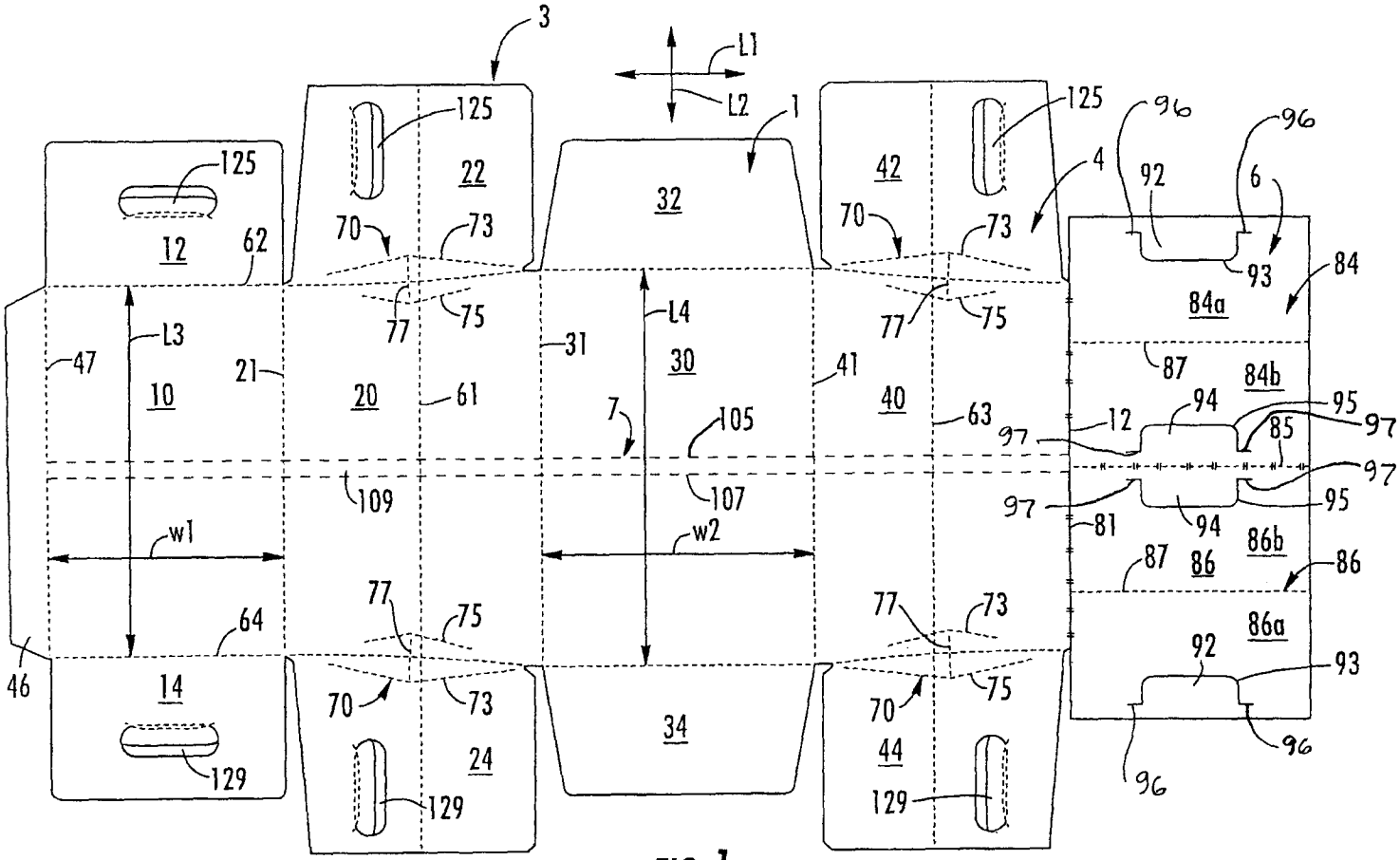
FIG. 1 is a plan view of an exterior surface of a blank used to form a carton according to a first embodiment of the disclosure.
Figure 9:
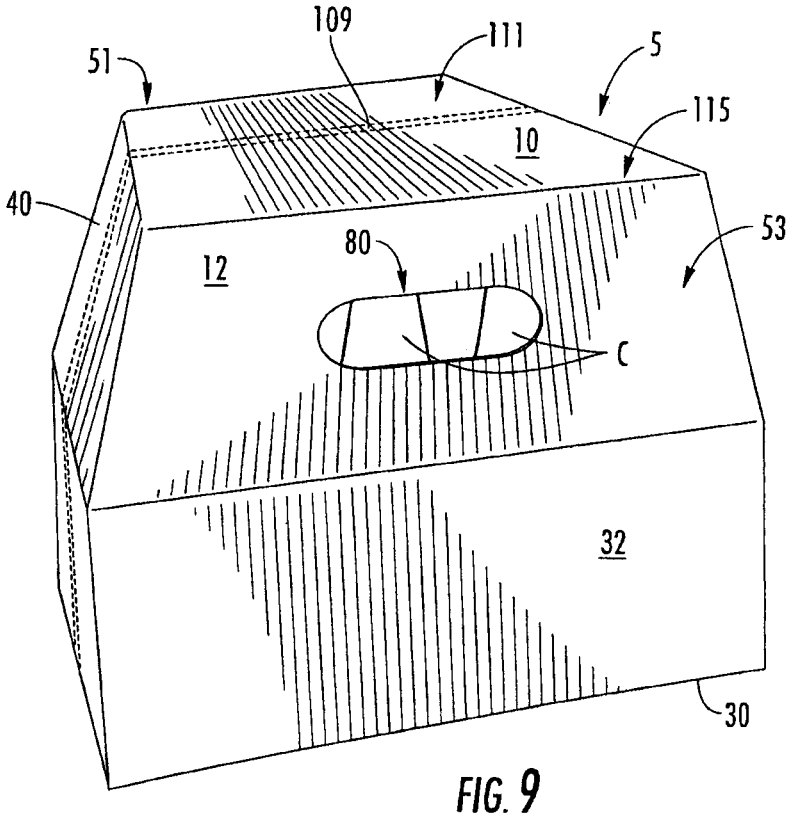
FIG. 9 is a perspective of the assembled carton.
Figure 10:
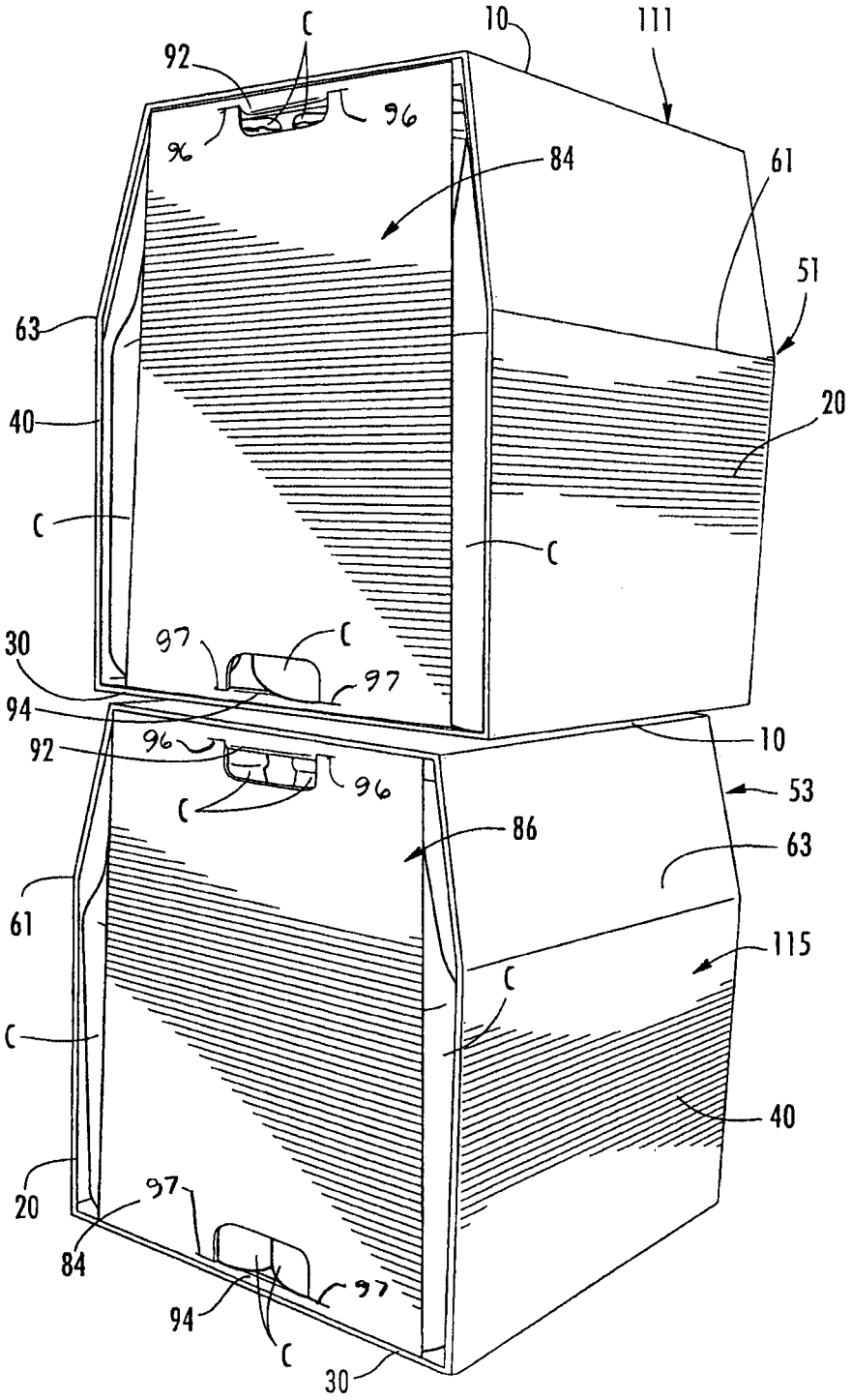
FIG. 10 is perspective of the carton of FIG. 9 separated into a first portion and a second portion.

FIG. 1 is a plan view of an exterior surface 1 of a blank 3 used to form a carton 5 (FIG. 9) according to a first exemplary embodiment of the disclosure. The carton 5 can be used to house a plurality of articles such as containers C (FIG. 10). The blank 3 has dispenser features that form a dispenser 7 in the carton 5 for allowing access to the containers C. In the illustrated embodiment, the containers C are bottles having a wide bottom B and a narrow top T including a cap CP. In the illustrated embodiment, the carton 5 is sized to house twenty-four containers C in a single layer in a 4×6 arrangement, but it is understood that the carton 5 may be sized and shaped to hold containers of a different or same quantity in more than one layer and/or in different row/column arrangements (e.g., 1×6, 2×6, 3×6, 2×6×2, 3×4×2, 2×9, 3×4, etc.). In the illustrated embodiment, the blank 3 includes handle features that form a handle 9 at a first end 51 of the carton 5 and a handle 11 at a second end 53 of the carton.

The blank 3 has a longitudinal axis L1 and a lateral axis L2. In the illustrated embodiment, the blank 3 comprises a carton blank 4 and a divider blank 6. As shown in FIG. 1, the divider blank 6 is attached to the carton blank 4 at a tear line 12, but the carton blank and the divider blank may be manufactured separately and may be free from attachment to each other. The carton blank 4 includes a top panel 10 foldably connected to a first side panel 20 at a first lateral fold line 21, a bottom panel 30 foldably connected to the first side panel 20 at a second lateral fold line 31, a second side panel 40 foldably connected to the bottom panel 30 at a third lateral fold line 41, and an adhesive panel 46 foldably connected to the top panel 10 at a fourth lateral fold line 47.

The top panel 10 is foldably connected to a first top end flap 12 and a second top end flap 14. The first side panel 20 is foldably connected to a first side end flap 22 and a second side end flap 24. The bottom panel 30 is foldably connected to a first bottom end flap 32 and a second bottom end flap 34. The second side panel 40 is foldably connected to a first side end flap 42 and a second side end flap 44. When the carton 5 is erected, the end flaps 12, 22, 32, 42 close the first end 51 of the carton, and the end flaps 14, 24, 34, 44, close the second end 53 of the carton. In accordance with an alternative embodiment of the present disclosure, different flap arrangements can be used for closing the ends 51, 53 of the carton 5.

The end flaps 12, 22, 32, 42 extend along a first marginal area of the carton blank 4, and are foldably connected at a first longitudinal fold line 62 that extends along the length of the blank. The end flaps 14, 24, 34 44 extend along a second marginal area of the carton blank 4, and are foldably connected at a second longitudinal fold line 64 that extends along the length of the blank. The longitudinal fold lines 62, 64 may be, for example, substantially straight, or offset at one or more locations to account for blank thickness or for other factors.

In the illustrated embodiment, the carton blank 4 includes four diamond-shaped corners, generally indicated 70. Two diamond-shaped corners 70 are formed in the first side panel 20 and cooperate with the respective longitudinal fold line 62, 64 to foldably connect the first and second side end flaps 22, 24 to the first side panel. Two diamond-shaped corners 70 are formed in the second side panel 40 and cooperate with respective longitudinal fold lines 62, 64 to foldably connect the first and second side end flaps 42, 44 to the second side panel. In the embodiment of FIG. 1, each diamond-shaped corner 70 comprises opposed v-shaped fold lines 73, 75 and a transverse fold line 77 that respectively connects the v-shaped fold lines 73, 75 of each corner.

In one embodiment, the carton blank 4 has a lateral fold line 61 extending through the side end flap 22, first side panel 20, and side end flap 24 so that each of these flaps and panels may be folded along the fold line 61 to have an upper portion that tapers inward relative to a lower portion. A lateral fold line 63 extends through the side end flap 42, second end panel 40, and side end flap 44 so that each of these flaps and panels may be folded along the fold line 63 to have an upper portion that tapers inward relative to a lower portion. The diamond-shaped corners 70 allow the first side panel 20, second side panel 40, and side end flaps 22, 24, 42, 44 to angle inward towards the interior of the carton 5 so that the carton forms a tight fit around the containers C housed in the carton. In an alternative embodiment, the diamond-shaped corners 70 may be otherwise shaped, arranged, and/or configured, or may be omitted.

In the illustrated embodiment, the divider blank 6 is removably attached to the second side panel 40 along a tear line 12. The divider blank 6 includes a first divider panel 84 and a second divider panel 86 that are in a generally mirror-image relationship relative to a line of weakness 85. In the illustrated embodiment, the line of weakness 85 is tear line, but the line of weakness may be a fold line, or any other form of weakness in the blank 6. Each of the first divider panel 84 and the second divider panel 86 have a fold line 87 extending in the longitudinal direction L1 across the width of the blank 6. The fold line 87 in the first divider panel 84 divides the first divider panel into a first (upper) upper portion 84*a* and a second (lower) portion 84*b*. The fold line 87 in the second portion 86 divides the second portion into a first (upper) portion 86*a* and a second (lower portion) 86*b*. In the illustrated embodiment, each of the first divider panel 84 and second divider panel 86 includes a first (upper) attachment flap 92 foldably connected to a respective upper portion 84*a*, 86*a* and a second (lower) attachment flap 94 foldably connected to a respective lower portion 84*b*, 86*b*. The upper attachment flaps 92 are for being respectively attached to the top panel 10 and the lower attachment flaps 94 are for being respectively attached to the bottom panel 30. The attachment flaps 92, 94 can be attached to respective panels 10, 30 by adhesive such as glue or other suitable adhesive. Each attachment flap 92, 94 is formed by a respective U-shaped cut 93, 95 in a respective portion 84*a*, 84*b*, 86*a*, 86*b* of the first divider panel 84 and second divider panel 86. Each U-shaped cut 93 has lateral extensions 96 that extend in the longitudinal direction L1 across a portion of a width of the divider panel 84. Each U-shaped cut 94 has lateral extensions 97 that extend in the longitudinal direction L1 across a portion of a width of the divider panel 86. It is understood that the divider panels 84, 86 and their respective parts may be otherwise shaped and arranged without departing from the disclosure.

The dispenser features 7 include two spaced apart tear lines 105, 107 extending in the longitudinal direction L1 of the blank 3 across the adhesive panel 46, top panel 10, first side panel 20, bottom panel 30, and second side panel 40. The spaced apart tear lines 105, 107 define a tear strip 109 between the tear lines. In the illustrate embodiment, the tear strip 109 is located approximately on the longitudinal centerline of the blank so that removal of the tear strip divides the carton 5 into two portions 111, 115 (FIG. 10) of approximately equal size. It is understood that the tear strip 109 could be otherwise shaped and arranged, or could be omitted. Further, the dispenser features 7 could include features other than the tear strip 109 for separating the carton 5 into two portions 111, 115.

In the illustrated embodiment, the handle features of the blank 3 include handle panels 125 respectively foldably connected to end flaps 12, 22, and 42 for forming a handle 80 in the first end 51 of the carton 5. Handle panels 129 are respectively foldably connected to end flaps 14, 24, 44 for forming a handle (not shown) in the second end 53 of the carton 5. The handle features could be otherwise shaped and/or arranged, or could be omitted.

Figure 2:
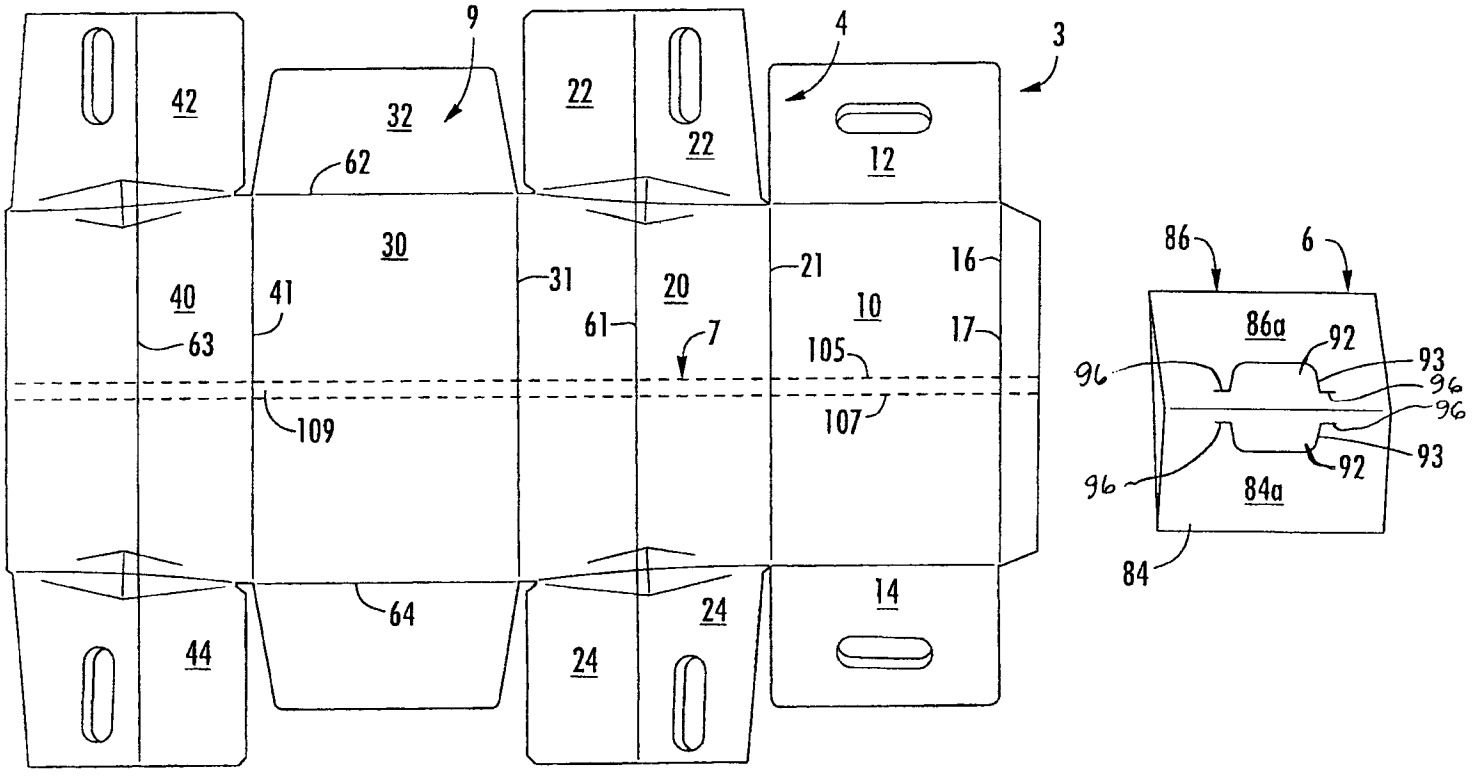
FIG. 2 is a plan view showing an interior surface of a carton blank and a divider blank at least partially assembled for positioning on the carton blank.
Figure 3:
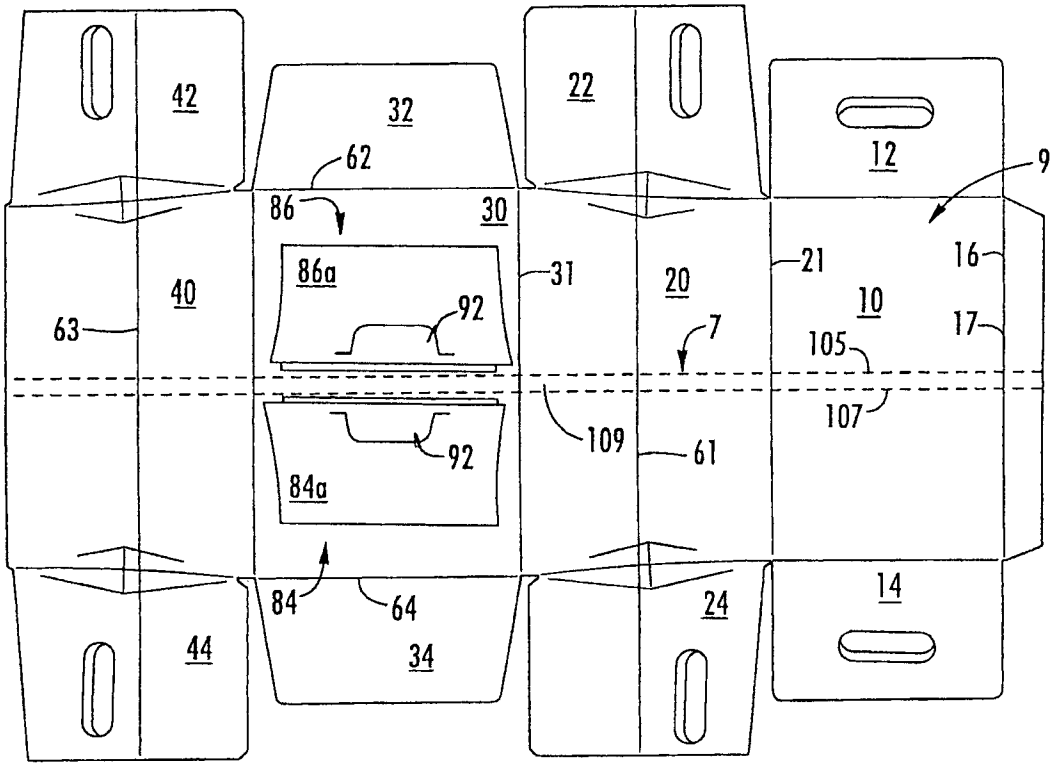
FIG. 3 is a plan view showing the divider blank of FIG. 2 positioned for attachment to the carton blank of FIG. 2.
Figure 4:
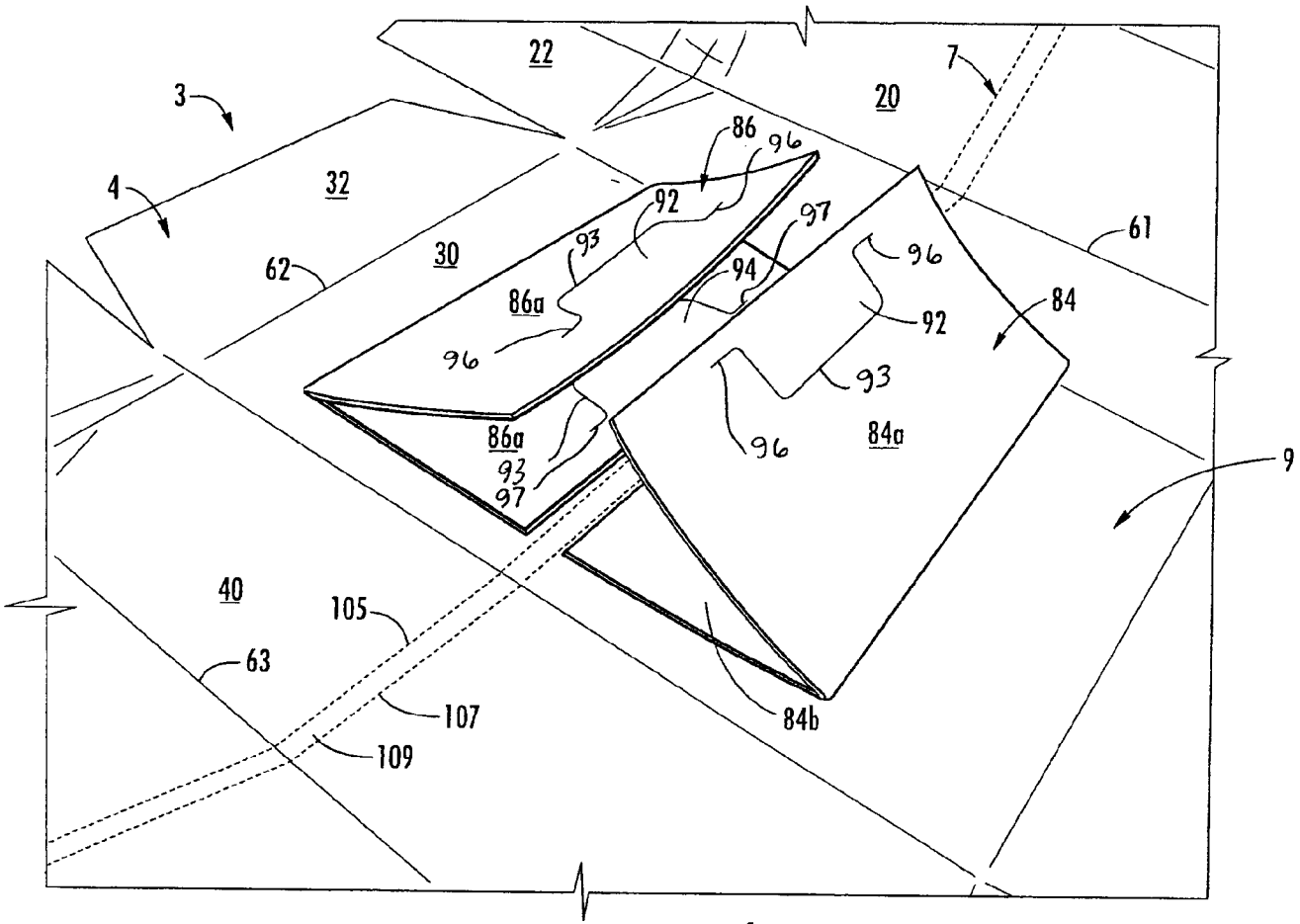
FIG. 4 is a perspective of the divider blank attached to the carton blank.
Figure 5:
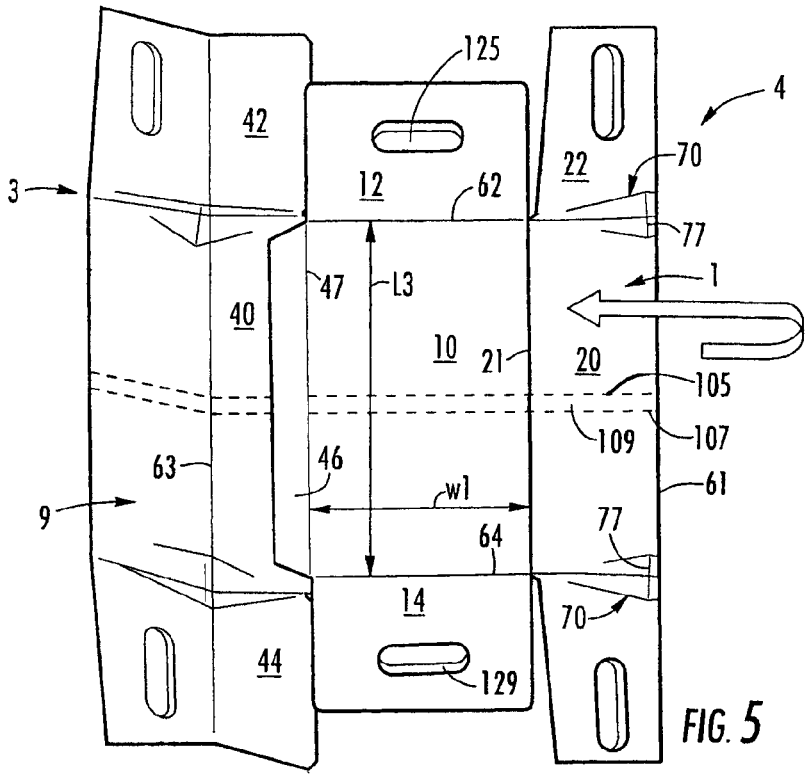
FIG. 5 is a plan view of the carton blank further positioned for attachment to the divider blank.
Figure 6:
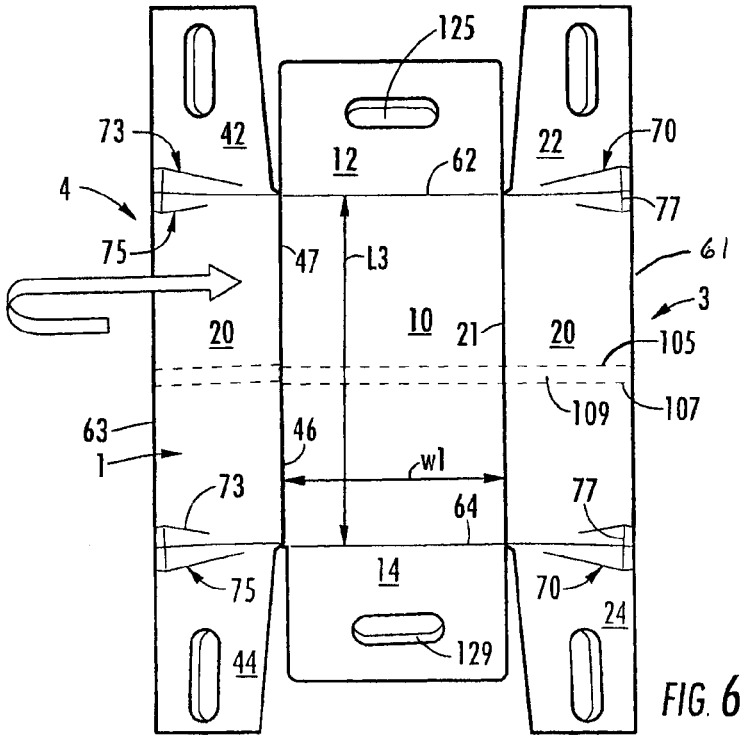
FIG. 6 is a plan view of the carton blank further positioned for forming the carton.

In accordance with one exemplary embodiment, the carton 5 can be assembled by first attaching the divider blank 6 to an interior surface 9 (FIG. 2) of the carton blank 4. As shown in FIG. 2, the divider panels 84, 86 are respectively folded about fold lines 87 such that the upper portions 84*a*, 86*a* are in respective face-to-face contact with the lower portions 84*b*, 86*b* of the divider panels. The folded divider panels 84, 86 can be separated along tear line 85. As shown in FIGS. 3 and 4, each folded divider panel 84, 86 is positioned on the interior surface 9 of the bottom panel 30. The attachment flap 94 of each lower portion 84*b*, 86*b* of the divider panels 84, 86 is adhesively connected to the bottom panel 30 by adhesive 98 (FIG. 7A). As shown in FIG. 5, the carton blank 4 is folded about the lateral fold line 61 in the first side panel 20 so that the top panel 10 in placed in an overlapping relationship with the folded divider panels 84, 86 and bottom panel 30. Prior to positioning the top panel 10, adhesive can be applied to the attachment flaps 92 and/or portions of the top panel to attach the divider panels 84, 86 to the top panel. As shown in FIG. 6, the carton blank 4 is folded about lateral fold line 63 in the second side panel 40 so that a marginal portion of the second side panel is in face-to-face contact with the adhesive flap 46. Prior to folding the blank 4 about lateral fold line 63, adhesive can be applied to either the marginal portion of the second side panel 40 or the adhesive flap 46.

Figure 7:
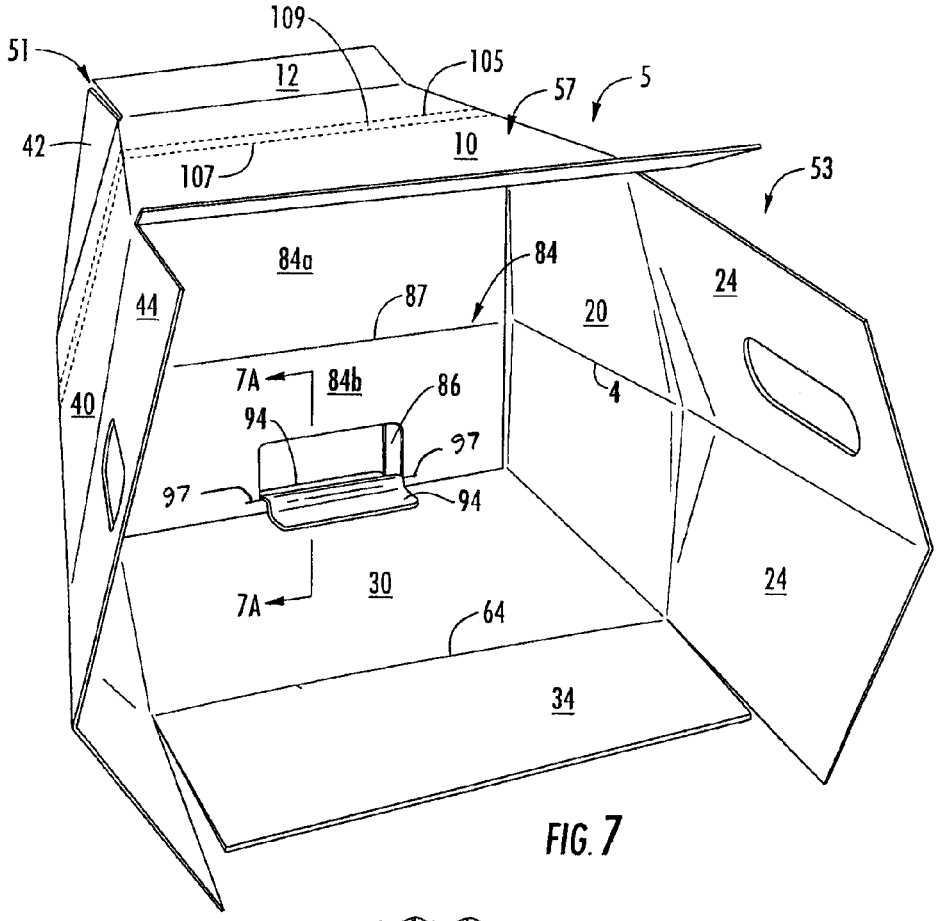
FIG. 7 is an end perspective of the carton blank of FIG. 6 further assembled into the carton.
Figure 7A:
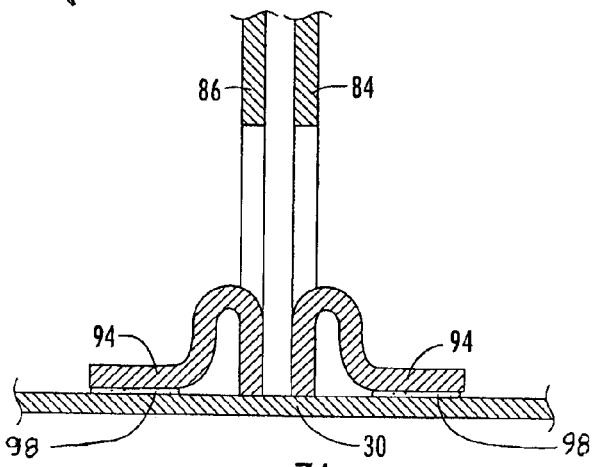
FIG. 7A is a partial cross-section of FIG. 7.
Figure 8:
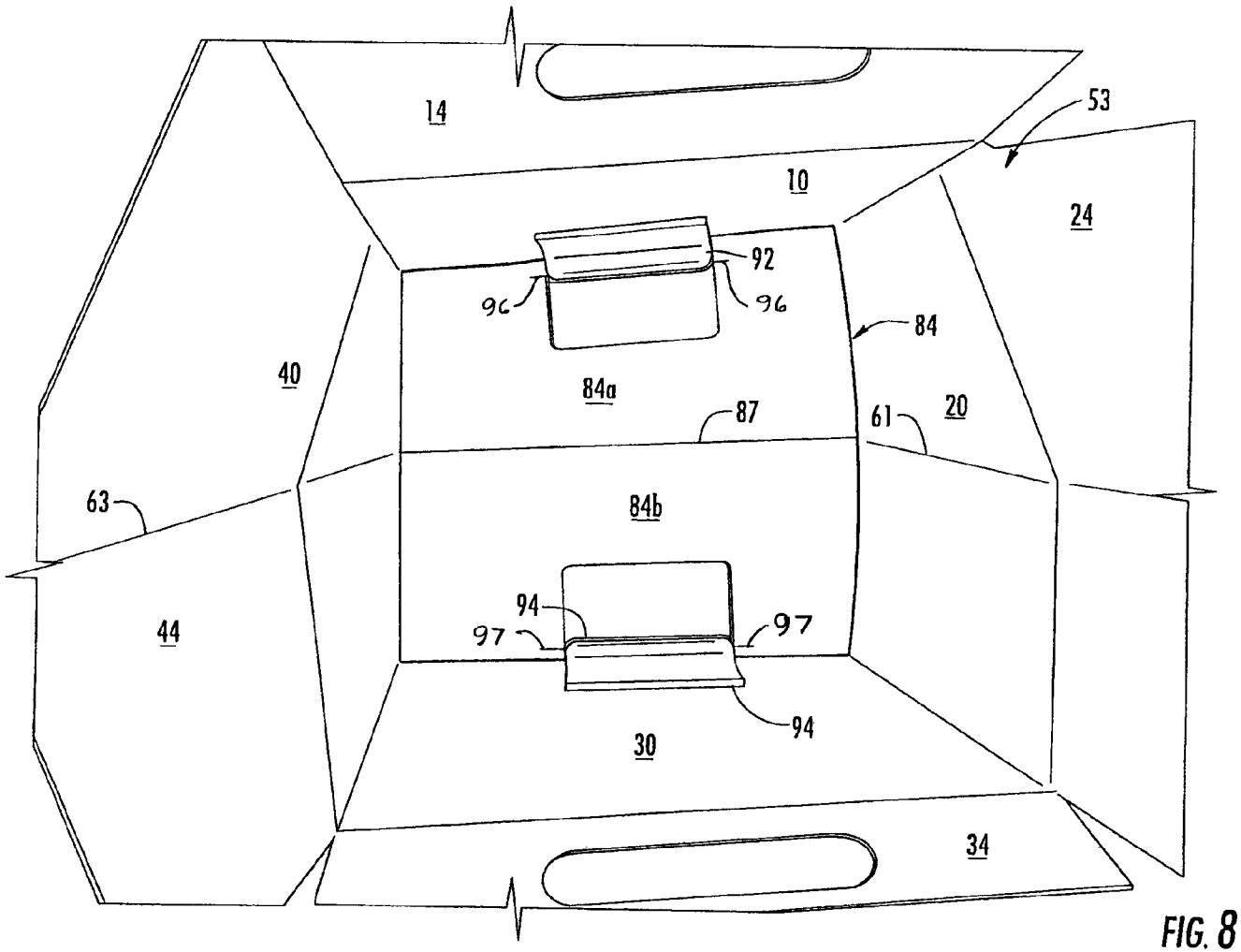
FIG. 8 is an enlarged view of the interior of the carton.

As shown in FIG. 7, the partially assembled carton blank 4 is folded along fold lines 21, 31, 41, 47, 61, 63 to form a generally open-ended sleeve 57. As shown in FIGS. 7, 7A, and 8, each divider panel 84, 86 extends between the top panel 10 and bottom panel 30 in the interior of the sleeve 57. When the open-ended sleeve 57 is formed, the divider panels 84, 86 are folded relative to respective attachment flaps 92, 94 which are attached to a respective top panel 10 and bottom panel 30. The divider panels 84, 86 extend generally perpendicular between the top and bottom panels 10, 30. The attachment flaps 94 are downwardly folded relative to a respective divider panel 84, 86 to be in face-to-face contact and attachment with the bottom panel 30. The attachment flaps 92 are upwardly folded relative to a respective divider panel 84, 86 to be in face-to-face contact and attachment with the top panel 10. The extensions 96, 97 of the cuts 93, 95 facilitate the positioning of the flaps 92, 94 relative to the divider panels 84, 86.

In the illustrated embodiment, the divider panels 84, 86 are located generally adjacent the tear strip 109 in the top panel 10, side panels 20, 40, and bottom panel 30. In the illustrated embodiment, twelve containers C are loaded into the first open end 51 of the sleeve 57 and twelve containers C are loaded into the second open end 53 of the sleeve. In the illustrated embodiment, the first end 51 of the carton 5 is closed by respectively overlapping and adhering the end flaps 12, 32, 22, 42 after the containers C are inserted into the carton. The second end 53 of the carton 5 is closed by respectively overlapping the end flaps 14, 34, 24, 44. It is understood that the carton 5 can be erected from the blank 3 using other methods and manipulations of the panels, flaps, etc., of the blank. Further, the divider panels 84, 86 can be otherwise positioned in alternative configurations of the carton without departing from the disclosure.

Figure 11:
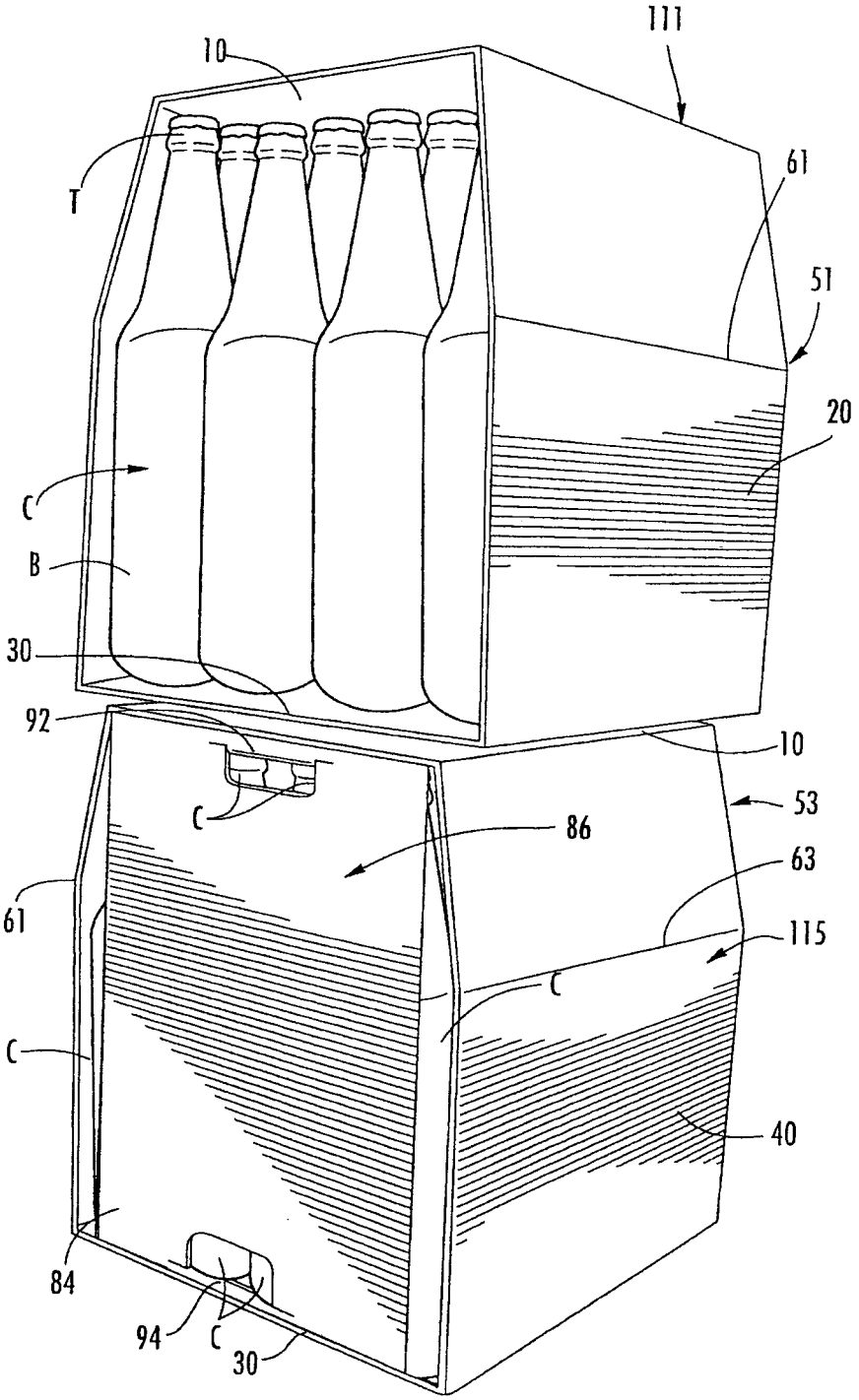
FIG. 11 is a perspective of a carton of a second embodiment assembled into a first portion and a second portion.

The carton 5 of the present disclosure is shaped to hold bottles C in an upright position such that the bottom B (FIG. 11) of the bottles is supported by the bottom panel 30 and the top portion T of the bottles is in contact with or adjacent to the top panel 10. The bottom panel 30 has a width W2 greater than a width W1 of the top panel 10 so that the side panels 20, 40, of the assembled carton 5 are inwardly tapered such that the bottom of each side panel contacts the bottom B of a respective container C and the top of each side panel contacts the cap CP of a respective container. The bottom panel 30 has a length L4 greater than a length L3 of the top panel 10 so that the end flaps 12, 22, 32, 42 at the first end 51 of the carton form an inwardly tapered end wall and the end flaps 14, 24, 34, 44 at the second end 53 of the carton form an inwardly tapered end wall. The diamond-shaped corners 70 of the carton 5 allow the top portion of each side panel 20, 40 to be angled inward and the top portion of each end flap 22, 24, 42, 44 to be angled inward so that the carton 5 is more narrow at the top where the side panels and end flaps connect with the top panel 10 than at the bottom where the side panels and end flaps connect with the bottom panel 30. This narrowing of the width of the carton 5 from the bottom to the top provides two points of contact of the side panels 20, 40 and end flaps 22, 24, 42, 44 with the bottles C to hold both the top T and the bottom B of the bottles in a relatively fixed position to prevent movement of the bottles in the carton.

The dispenser features 7 are activated by removing the tear strip 109 to separate the carton 5 into the two portions 111, 115. The tear strip 109 may be removed from the carton 5 by completely tearing the carton along tear lines 105, 107. Alternatively, the tear strip 109 may be only partially removed or the tear strip may not extend fully across the panels 10, 20, 30, 40 so that the two portions 111, 115 of the carton remain hingedly attached. It is understood that the dispenser features 7 may be otherwise sized and shaped to correspond with various other sizes and shapes of containers C which may be housed in the carton 5, and to form other sizes, locations, and/or methods of opening the carton.

As shown in FIG. 10, when the tear strip 109 is separated the two portions 111, 115 of the carton 5 form separate packages, each holding twelve containers C. In the illustrated embodiment, the first portion 111 is closed by the end flaps 12, 22, 32, 42 at the first closed end 51 of the carton and the second divider panel 84. The second portion 115 of the carton 5 is closed by the end flaps 14, 24, 34, 44 at the second closed end 53 of the carton and the first divider panel 86. The closed ends of each portion 111, 115 prevent containers C in each portion from falling out when each portion is carried or transported. As shown in the alternative embodiment of the carton 5 of FIG. 11, the carton may have a single divider panel 84 that closes one of the portions 115 so that the containers C of the other portion 115 are accessible without the need to remove a divider panel.

The blank according to the present disclosure can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described herein. The blank can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines may include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

The above embodiments may be described as having one or more panels adhered together by glue during erection of the carton embodiments. The term "glue" is intended to encompass all manner of adhesives commonly used to secure carton panels in place.

The foregoing description illustrates and describes various embodiments of the present disclosure. As various changes could be made in the above construction, it is intended that all matter contained in the above description or shown in the accompanying drawings shall be interpreted as illustrative and not in a limiting sense. Furthermore, the present disclosure covers various modifications, combinations, alterations, etc., of the above-described embodiments. It will be understood by those skilled in the art that while the present disclosure has been discussed above with reference to exemplary embodiments, various additions, modifications and changes can be made thereto without departing from the spirit and scope of the claims. Furthermore, certain features and characteristics of each embodiment may be selectively interchanged and applied to other illustrated and non-illustrated embodiments without departing from the scope of the disclosure.

What is claimed is:

1. A method of forming a carton from a blank, the method comprising:

obtaining a carton blank and a divider blank, the carton blank comprising a plurality of panels comprising at least a top panel, a bottom panel, a first side panel, and a second side panel, the carton blank comprising dispenser features, the divider blank comprising at least one divider panel having a main portion and a first attachment flap foldably connected to the main portion and a second attachment flap foldably connected to the main portion, each of the first attachment flap and the second attachment flap being at least partially defined by a respective cut extending in the main portion of the at least one divider panel, attaching the divider blank to the carton blank by securing the first attachment flap in face-to-face contact with the top panel and securing the second attachment flap in face-to-face contact with the bottom panel;

forming a carton from the carton blank by positioning the top panel, bottom panel, first side panel, and second side panel to form a generally open-ended sleeve;

forming the divider by positioning the divider blank to extend between the top panel and the bottom panel and divide the carton into a first portion and a second portion.

2. The method of claim 1, wherein the open-ended sleeve has an open first end and an open second end, and the method further comprising loading containers into the open-ended sleeve from the first end and loading containers into the open-ended sleeve from the second end.

3. The method of claim 2, wherein the carton blank comprises a plurality of first end flaps foldably connected to respective panels of the plurality panels at a first end of the blank and a plurality of second end flaps foldably connected to respective panels of the plurality of panels at a second end of the blank, the method further comprising positioning the first end flaps to close the first end and positioning the second end flaps to close the second end.

4. The method of claim 3, further comprising activating the dispensing features to separate the first portion from the second portion of the carton.

5. The method of claim 4, wherein:

the at least one divider panel comprises a first divider panel that forms a first closed end of the first portion of the carton and the first end flaps form a closed second end of the first portion; and the at least one divider panel comprises a second divider panel that forms a first closed end of the second portion of the carton and the second end flaps form a closed second end of the second portion.

6. The method of claim 1 wherein the first side panel comprises a first lateral fold line extending across a length of the first side panel and the second side panel comprises a second lateral fold line extending across a length of the second side panel, the attaching the divider blank comprises folding the carton blank along one of the first lateral fold line and the second lateral fold line to position a respective one of the top panel and the bottom panel in face-to-face relationship with at least a portion of the divider panel, wherein the first side panel or the second side panel comprises an upper section and a lower section, the upper section being at least partially in face-to-face relation with the lower section after the folding the blank along the one of the first lateral fold line and the second lateral fold line.

7. The method of claim 6 further comprising folding the blank along the other of the first lateral fold line and the second lateral fold line to position a respective one of the first side panel and the second side panel for attachment to a respective one of the top panel and the bottom panel.

8. The method of claim 1, wherein the main portion of the at least one divider panel comprises an outer edge that extends around a periphery of the at least one divider panel, each respective cut being spaced apart from the outer edge.

9. The method of claim 1, wherein the main portion of the at least one divider panel comprises an edge, the edge being disposed adjacent the at least one of the panels, each respective cut being spaced apart from the edge.

10. A method of forming a carton from a blank, the method comprising:

obtaining a carton blank and a divider blank, the carton blank comprising a plurality of panels comprising at least a top panel, a bottom panel, a first side panel, and a second side panel, the divider blank comprising at least one divider panel comprising a main portion and a first attachment flap foldably connected to the main portion and a second attachment flap foldably connected to the main portion, attaching the divider blank to the carton blank by securing the first attachment flap in face-to-face contact with the top panel and securing the second attachment flap in face-to-face contact with the bottom panel;

forming a carton from the carton blank by positioning the top panel, bottom panel, first side panel, and second side panel to form a generally open-ended sleeve;

forming the divider by positioning the divider blank to extend between the top panel and the bottom panel and divide the carton into a first portion and a second portion.

11. The method of claim 10, wherein each of the first attachment flap and the second attachment flap is at least partially defined by a respective cut extending in the main portion of the at least one divider panel.

12. The method of claim 10, wherein the attaching the divider blank to the carton blank comprises positioning the first attachment flap, the second attachment flap, and at least an adjacent portion of the main portion of the divider panel in face-to-face contact with the at least one panel.

13. The method of claim 12, wherein the positioning the divider blank to divide the carton comprises pivoting the main portion of the divider panel relative to the first attachment flap, the second attachment flap, and the at least one panel.

14. The method of claim 12, wherein:

the divider panel comprises a first portion foldably connected to a second portion;

the first attachment flap is foldably connected to the first portion of the divider panel and the second attachment flap is foldably connected to the second portion of the divider panel; and the attaching the divider blank to the carton blank comprises folding the first portion toward the second portion so that the first attachment flap is adjacent the second attachment flap, positioning the first portion of the divider panel in face-to-face contact with the at least one panel.

15. The method of claim 14, wherein:

the first side panel comprises a first lateral fold line extending across a length of the first side panel and the second side panel comprises a second lateral fold line extending across a length of the second side panel; and the attaching the divider blank to the carton blank comprises folding the carton blank along at least one of the first lateral fold line and the second lateral fold line to position the top panel in face-to-face relationship with the second portion of the divider panel.

16. The method of claim 10, wherein the carton blank comprises a plurality of first end flaps foldably attached to respective panels of the plurality panels at a first end of the carton blank and a plurality of second end flaps foldably connected to respective panels of the plurality of panels at a second end of the carton blank, the method further comprising positioning the first end flaps to close the first end and positioning the second end flaps to close the second end after the forming the divider.

17. Blanks for forming a carton for containing at least one divider, the blanks comprising:

a first blank for being formed into the carton, the first blank comprising a plurality of panels comprising at least a top panel, a bottom panel, a first side panel, a second side panel, and dispenser features for separating the carton formed from the first blank into a first portion and a second portion;

a second blank for forming the at least one divider, the at least one divider is for at least partially closing at least one of the first portion and the second portion of the carton, the second blank comprising a divider panel, the divider panel comprising a main portion and at least one attachment flap foldably connected to the main portion, the at least one attachment flap being attached in face-to-face contact with at least one of the top panel and the bottom panel, the at least one attachment flap and at least an adjacent portion of the main portion of the divider panel are in face-to-face contact with the at least one panel, the divider panel comprises a first portion foldably connected to a second portion, the at least one attachment flap comprises a first attachment flap foldably connected to the first portion of the divider panel and a second attachment flap foldably connected to the second portion of the divider panel; and the divider blank is folded so that the first portion is adjacent the second portion, and the first portion of the divider panel in face-to-face contact with the bottom panel, the first attachment flap being attached in face-to-face contact with the bottom panel.

18. The blanks of claim 17, wherein the at least one attachment flap is at least partially defined by at least one cut extending in the main portion.

19. The blanks of claim 18, wherein the main portion of the divider panel comprises an outer edge that extends around a periphery of the second blank, the at least one cut being spaced apart from the outer edge.

20. The blanks of claim 17, wherein the first blank comprises a plurality of first end flaps foldably attached to respective panels of the plurality panels at a first end of the first blank for at least partially forming a first closed end of the carton formed from the first blank and a plurality of second end flaps foldably connected to respective panels of the plurality of panels at a second end of the first blank for at least partially forming a second closed end of the carton formed from the first blank.

21. The blanks of claim 17, wherein the at least one attachment flap is releasably attached to the top panel or the bottom panel.

22. Blanks for forming a carton for containing at least one divider, the blanks comprising:

a first blank for being formed into the carton, the first blank comprising a plurality of panels comprising at least a top panel, a bottom panel, a first side panel, a second side panel, and dispenser features for separating the carton formed from the first blank into a first portion and a second portion;

a second blank for forming the at least one divider, the at least one divider is for at least partially closing at least one of the first portion and the second portion of the carton, the second blank comprising a divider panel, the divider panel comprising a main portion and at least one attachment flap foldably connected to the main portion, the at least one attachment flap being attached in face-to-face contact with at least one of the top panel and the bottom panel, wherein:

the second blank is for forming a first divider, and the divider panel is a first divider panel;

the blanks further comprise a third blank for forming a second divider, the third blank comprising a second divider panel; and the first divider panel is for closing a first portion of the carton formed from the first blank, and the second divider panel is for closing a second portion of the carton formed from the first blank.

23. The blanks of claim 22, wherein the first blank comprises a tear strip for separating the carton formed from the first blank into a first portion and a second portion, the first divider panel and the second divider panel being attached to the first blank on respective sides of the tear strip.

* * * * *